US012613083B2

(12) United States Patent
Groves

(10) Patent No.: US 12,613,083 B2
(45) Date of Patent: Apr. 28, 2026

(54) CONFIGURATION FOR SPIN STABILIZED LESS LETHAL MUNITIONS

(71) Applicant: KWESST Inc., Ottawa (CA)

(72) Inventor: Greyson Blaine Groves, Dundas (CA)

(73) Assignee: KWESST Inc., Ottawa (CA)

( * ) Notice: Subject to any disclaimer, the term of this patent is extended or adjusted under 35 U.S.C. 154(b) by 0 days.

(21) Appl. No.: 18/978,828

(22) Filed: Dec. 12, 2024

(65) Prior Publication Data

US 2025/0198733 A1 Jun. 19, 2025

Related U.S. Application Data

(60) Provisional application No. 63/609,671, filed on Dec. 13, 2023.

(51) Int. Cl.
*F42B 14/02* (2006.01)

(52) U.S. Cl.
CPC ..... *F42B 14/02* (2013.01)

(58) Field of Classification Search
CPC ..... F42B 14/02
USPC ..... 102/439
See application file for complete search history.

(56) References Cited

U.S. PATENT DOCUMENTS 4,610,205 A * 9/1986 Bentley ..... F42B 14/02 102/524
7,380,505 B1 * 6/2008 Shiery ..... F42B 12/34 102/524
9,157,715 B1 * 10/2015 Lafortune ..... F42B 12/40
2014/0109791 A1 * 4/2014 Whitworth ..... F42B 14/04 102/529
2017/0115104 A1 * 4/2017 Peterson ..... F42B 12/745
2023/0152071 A1 * 5/2023 Rebar ..... F42B 30/02 102/520

FOREIGN PATENT DOCUMENTS

GB 2336197 A * 10/1999 ..... F42B 14/02

* cited by examiner

*Primary Examiner* — Samir Abdosh
(74) *Attorney, Agent, or Firm* — Ilya Chernyavskiy; Bennet K. Langlotz; Langlotz Patent & Trademark Works, LLC

(57) ABSTRACT

A blunt impact munition cartridge for firing from a barrel having grooves defining a first bore diameter and lands defining a lesser second bore diameter. The cartridge comprises a case that has a propellant and defining a forward case mouth, and an elastomeric projectile. The projectile has a body portion having a cylindrical sidewall configured to be closely received in the barrel. The projectile includes a first polymeric ring encircling the body portion and has a first ring diameter. The projectile includes a second polymeric ring encircling the body portion and having a second ring diameter different from the first diameter.

17 Claims, 7 Drawing Sheets

CONFIGURATION FOR SPIN STABILIZED LESS LETHAL MUNITIONS

CROSS-REFERENCE TO RELATED APPLICATION

This application claims the benefit of U.S. Provisional Patent Application No. 63/609,671 filed on Dec. 13, 2023, entitled "CONFIGURATION FOR SPIN STABILIZED LESS LETHAL MUNITIONS," which is hereby incorporated by reference in their entirety for all that is taught and disclosed therein.

FIELD OF THE TECHNOLOGY

The present invention relates to firearm projectiles, more particularly to less lethal ammunition.

BACKGROUND AND SUMMARY OF THE TECHNOLOGY

Less lethal blunt impact munitions work by striking with enough force to deter or incapacitate a target while attempting to lower the probability of serious injury or death. The nature of these munitions employs energy absorbing materials and physical configurations to control energy transfer upon impact. When these products are employed, it is critical that the projectiles are delivered in an accurate way to avoid striking vulnerable areas of a target, such as the head, face, or genitals.

Accuracy of fire is achieved, in part, by imparting spin on the projectile to stabilize it in flight. This is accomplished by rifling lands within the barrel of the launcher of such munitions. When a projectile is fired down the barrel, the rifling lands will engrave a driving band and spin the projectile.

Many less lethal munitions launchers employ hand-loading an individual round into a conventional chamber that is smooth, with rifling commencing just in front of the chamber towards the muzzle of the barrel. Any part of the projectile that is forward of the driving band must have a smaller diameter so as to not interfere with the rifling in the barrel. Otherwise, the munition could not be loaded by hand. Soft materials ahead of the driving band cannot provide reliable axial alignment with the bore of the launcher.

Some less lethal munitions will extend a rigid material forward of the driving band, which may provide better axial alignment, but do so at the cost of reducing energy absorbing material at the front end of the projectile. Some less lethal munitions use a soft material with a hard plastic base plate or drive band that engages the rifling. Such tend to be less accurate or have disadvantages in that the hard plastic materials risk undesired impact or injury on targets.

The preferred embodiment overcomes these limitations by providing a blunt impact munition cartridge for firing from a barrel having grooves defining a first bore diameter and lands defining a lesser second bore diameter. The cartridge comprises a case that has a propellant and defining a forward case mouth, and an elastomeric projectile. The projectile has a body portion having a cylindrical sidewall configured to be closely received in the barrel. The projectile includes a first polymeric ring encircling the body portion and has a first ring diameter. The projectile includes a second polymeric ring encircling the body portion and having a second ring diameter different from the first diameter. The significance of this approach is there is no need for a rigid plastic piece comprising a base at the rear of the projectile to guide it forward and impart spin. The approach allows the entire body of the projectile to be a soft material, which decreases the likelihood of undesired injury. The second ring also improves accuracy. Without the second ring, a soft material projectile is likely to deform and drag down the barrel, and provide a less accurate coaxial alignment with the barrel resulting in decreased accuracy.

DETAILED DESCRIPTION

Figure 1:
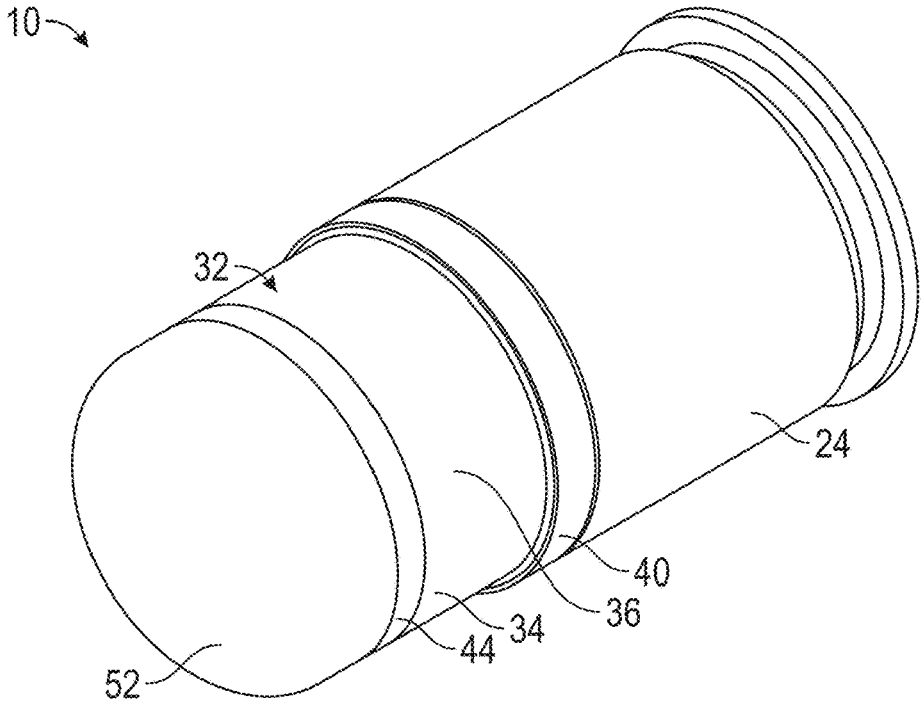
FIG. 1 shows an isometric view of the munition.

An embodiment of the blunt impact munition cartridge of the present embodiment is shown and generally designated by the reference numeral 10. FIGS. 1 through 10 show a blunt impact munition cartridge 10 for firing from a barrel 12 having grooves 14 defining a first bore diameter 16 and lands 20 defining a lesser second bore diameter 22. The cartridge has a case 24 having a propellant 26 and defining a forward case mouth 30 and an elastomeric projectile 32. The projectile has a body portion 34 having a cylindrical sidewall 36 configured to be closely received in the barrel.

The projectile includes a first ring 40, also referred to as a polymeric driving band, encircling the body portion and having a first ring diameter 42, and the projectile includes a second ring 44, also referred to as a polymeric guide ring, encircling the body portion and having a second ring diameter 46 different from the first diameter. The first ring diameter is sized to be closer to the first bore diameter than the second bore diameter, being sized to have an interference fit with the lands. The second ring diameter is sized to be closer to the second bore diameter than the first bore diameter, being sized to have a slip fit with the lands. The polymeric guide ring is forward of the polymeric driving band. The polymeric driving band and polymeric guide ring are spaced apart, with the polymeric driving band proximate a rear end portion 50 of the body portion and the polymeric guide ring is proximate a forward end portion 52 of the body portion. The polymeric driving band and polymeric guide ring may be spaced apart by at least half the length of the cylindrical sidewall. The body portion has a body diameter 54, the first ring diameter is greater than the body diameter, and the second ring diameter is approximately equal to the body diameter such that the polymeric guide ring has an external surface approximately flush with the body portion cylindrical sidewall.

The case has an internal rib 56 encircling the case mouth. The projectile defines a circumferential groove 60 receiving the case rib. The polymeric driving band and polymeric guide ring may be different materials from the body portion and may be polymeric. The body portion may be elastomeric.

Figure 2:
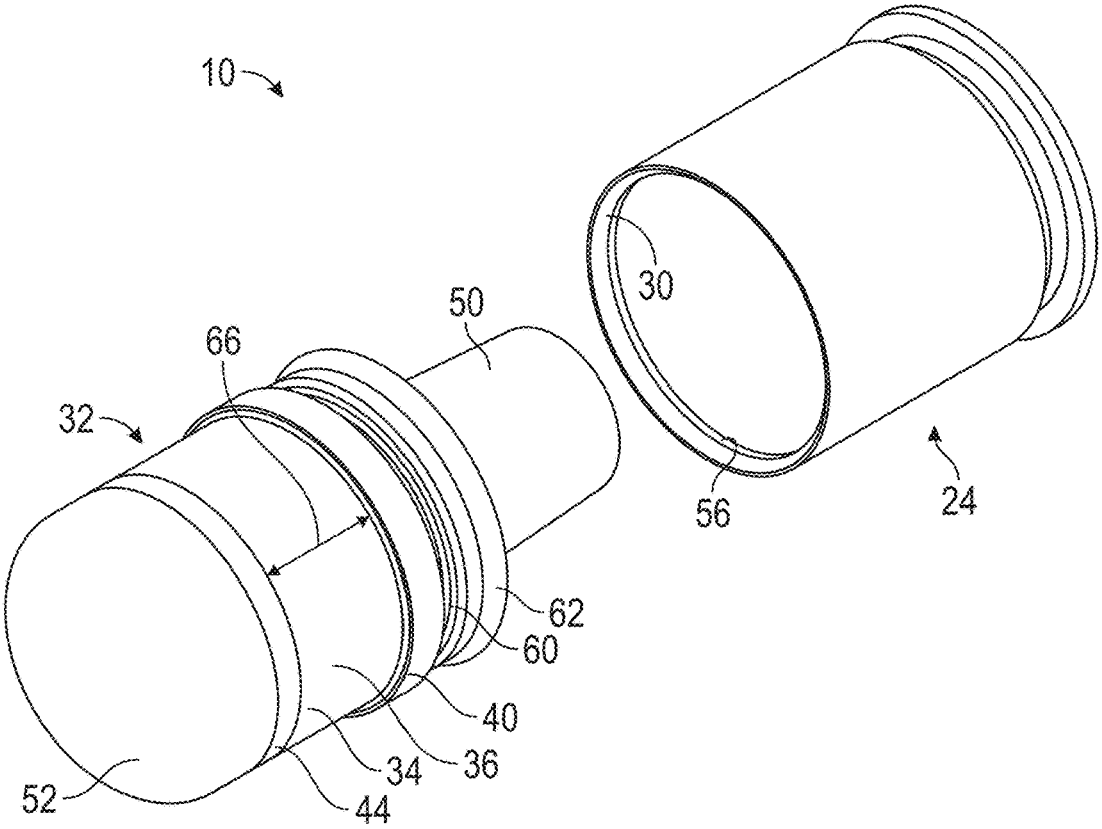
FIG. 2 shows an exploded view of the munition.

FIGS. 1 and 2 show an isometric view of the blunt impact munition cartridge 10. FIG. 2 is an exploded view of FIG. 1. The cartridge comprises of a case 12 and an elastomeric projectile 30. The elastomeric projectile has a forward end portion 52, a rear end portion 50, body portion 34 with a cylindrical sidewall 36. Towards the rearward end portion is a polymeric driving band 40 encircling the body portion. Towards the forward end portion is a polymeric guide ring 44. The projectile defines a circumferential groove 60 aft of the polymeric driving band, towards the end portion. The projectile further defines a flared portion 64 aft of the circumferential ring, towards the end portion. The end portion is narrower in diameter than the cylindrical body with a tapered end in the present embodiment but may be of the same diameter as the cylindrical body in other embodiments. The polymeric driving band and polymeric guide ring are spaced apart by a distance 66. The case has a forward case mouth 30 with an internal rib 56.

Figure 3B:
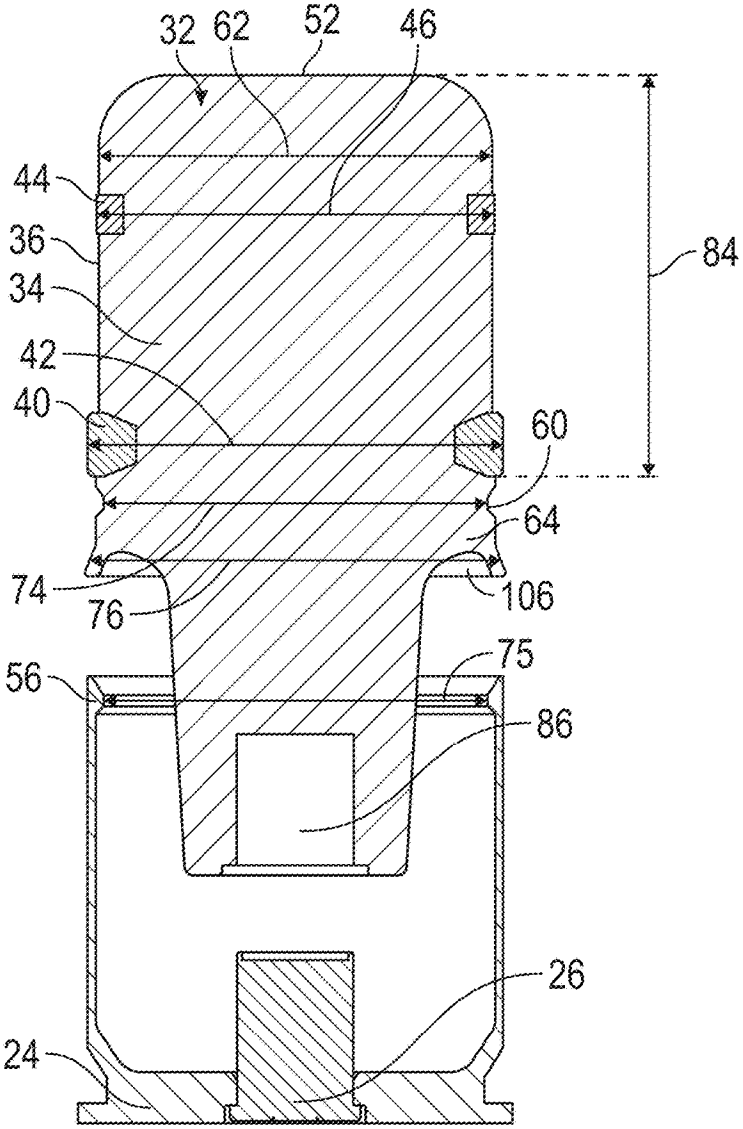
FIG. 3B shows a section view of the munition with the projectile separated from the cartridge case.
Figure 3A:
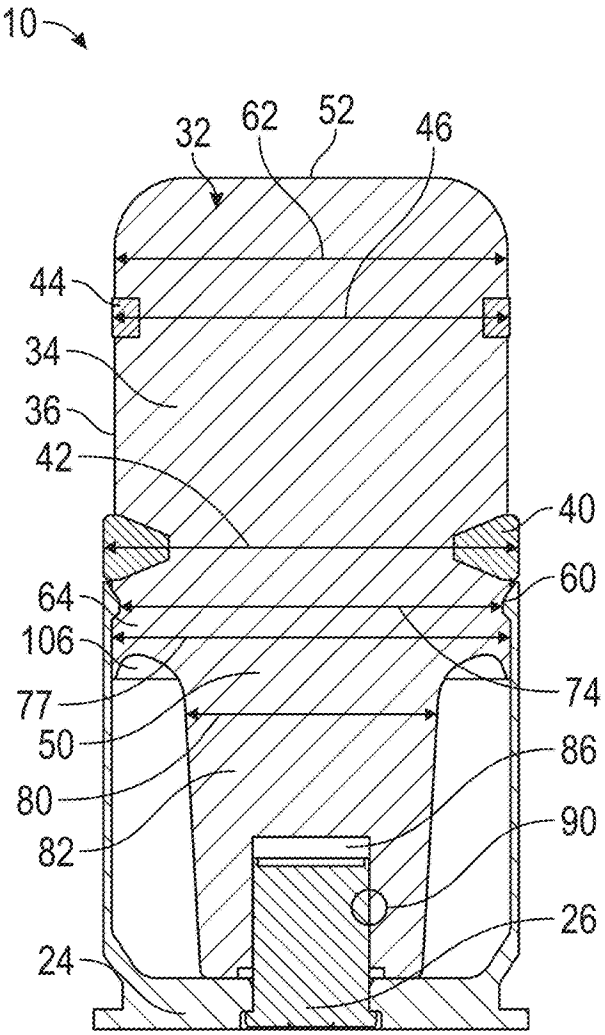
FIG. 3A shows a section view of the munition.

FIGS. 3A and 3B show section views of the blunt impact munition cartridge 10. FIG. 3B shows the projectile 32 separated partially from the case 24. The elastomeric projectile has a forward end portion 52, a rear end portion 50, body portion 34 with a cylindrical sidewall 36 having a diameter 62. Towards the rearward end portion is a polymeric driving band 40 encircling the body portion having a diameter 42 that is greater than the body diameter. Towards the forward end portion is a polymeric guide ring 44 with a diameter 46 that is approximately the same as the body diameter resulting in being approximately flush with the cylindrical sidewall. The projectile defines a circumferential groove 60 aft of the polymeric driving band, towards the end portion and having a diameter 74. The projectile further defines a flared portion 64 aft of the circumferential ring, towards the end portion. The flared portion has a diameter 76 at least the diameter of the first ring diameter when apart from the case as shown in FIG. 3B, and a compressed diameter 77 smaller than the case mouth diameter when inserted into the case as shown in FIG. 3A. The end portion is narrower in diameter 80 than the cylindrical body diameter and has a tapered end 82 in the present embodiment but may be of the same diameter as the cylindrical body in other embodiments. The end portion defines a cavity 86 into which the propellant 24 is inserted via a slip fit 90.

The polymeric driving band and polymeric guide ring are spaced apart by a distance 66. The distance needs to be wide enough to provide stability for the projectile in the barrel 12. There may be an advantage for having the forward ring reasonably adjacent to the nose of the projectile ensures that the projectile does not destabilize in the barrel. This distance may be a ratio of the diameter 42 of the polymeric driving band and length 84 of the body of the projectile. The ratio is preferably at least 0.17 to provide suitable coaxial alignment, and preferably at most 0.45 to keep the guide ring rear of the ogive that deforms and interacts with its target upon impact to minimize injury. The ring and driving band being further apart provides a more accurate shot. If the ring is too close to the front the ring could add to injury of the target. It could be destabilizing to have the two rings close together. The case has a forward case mouth 30 with an internal rib 56 having an internal diameter 75. The projectile is retained within the case by groove 60 mating with rib 56. The flared portion defines a space 106.

Figure 4:
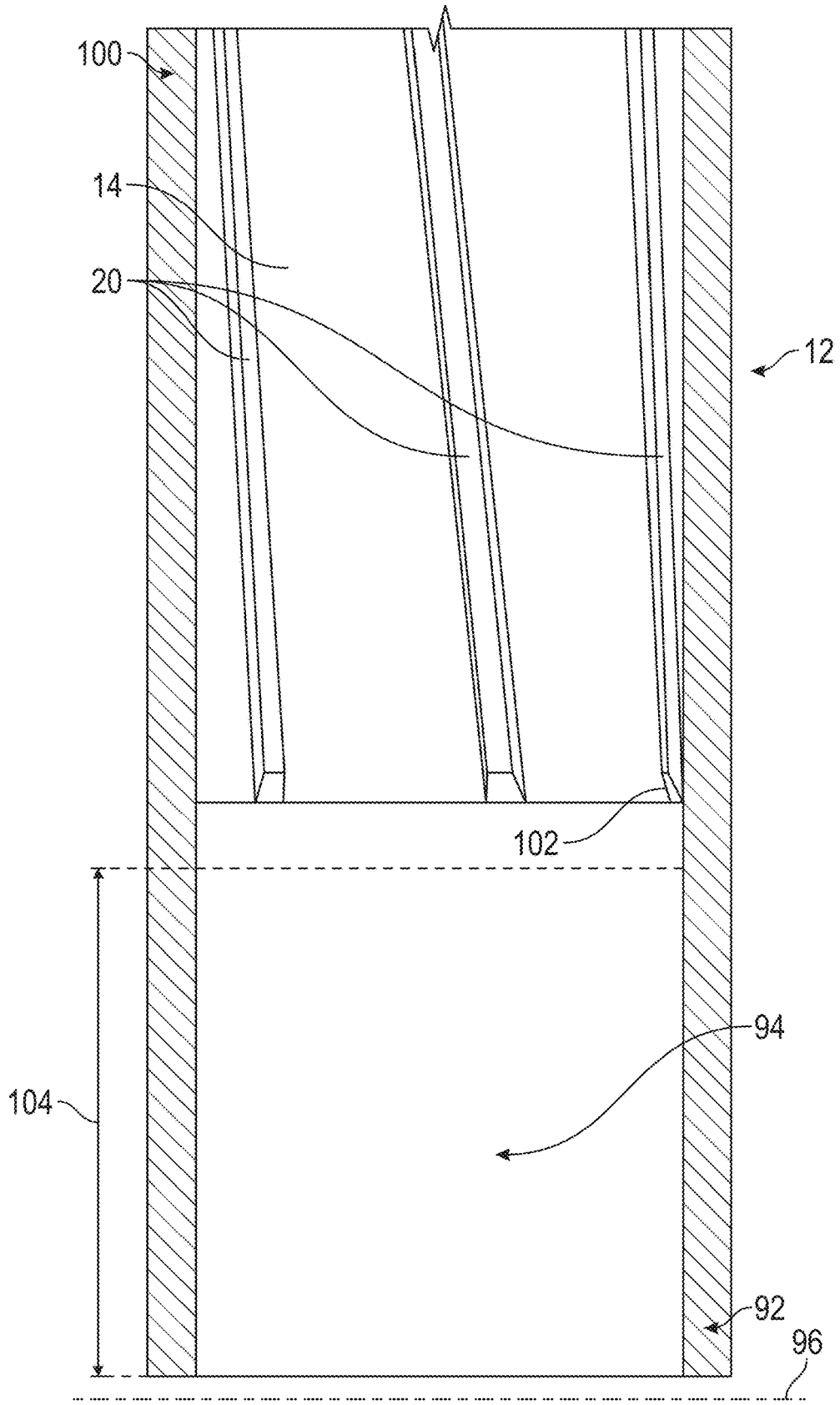
FIG. 4 shows a section view of a less lethal barrel with a smooth integral chamber configuration.

FIG. 4 shows a barrel 12 into which the blunt impact munition cartridge 10 is inserted. The barrel has a first end 92 defining a chamber 94 towards the breech face 96 of a firearm. There is an opposing second end 100 that goes to the muzzle of the barrel. The barrel is rifled beginning at the end of the chamber 102, having grooves 14 and lands 20. The length of a case 104 is inserted into the chamber.

Figure 5:
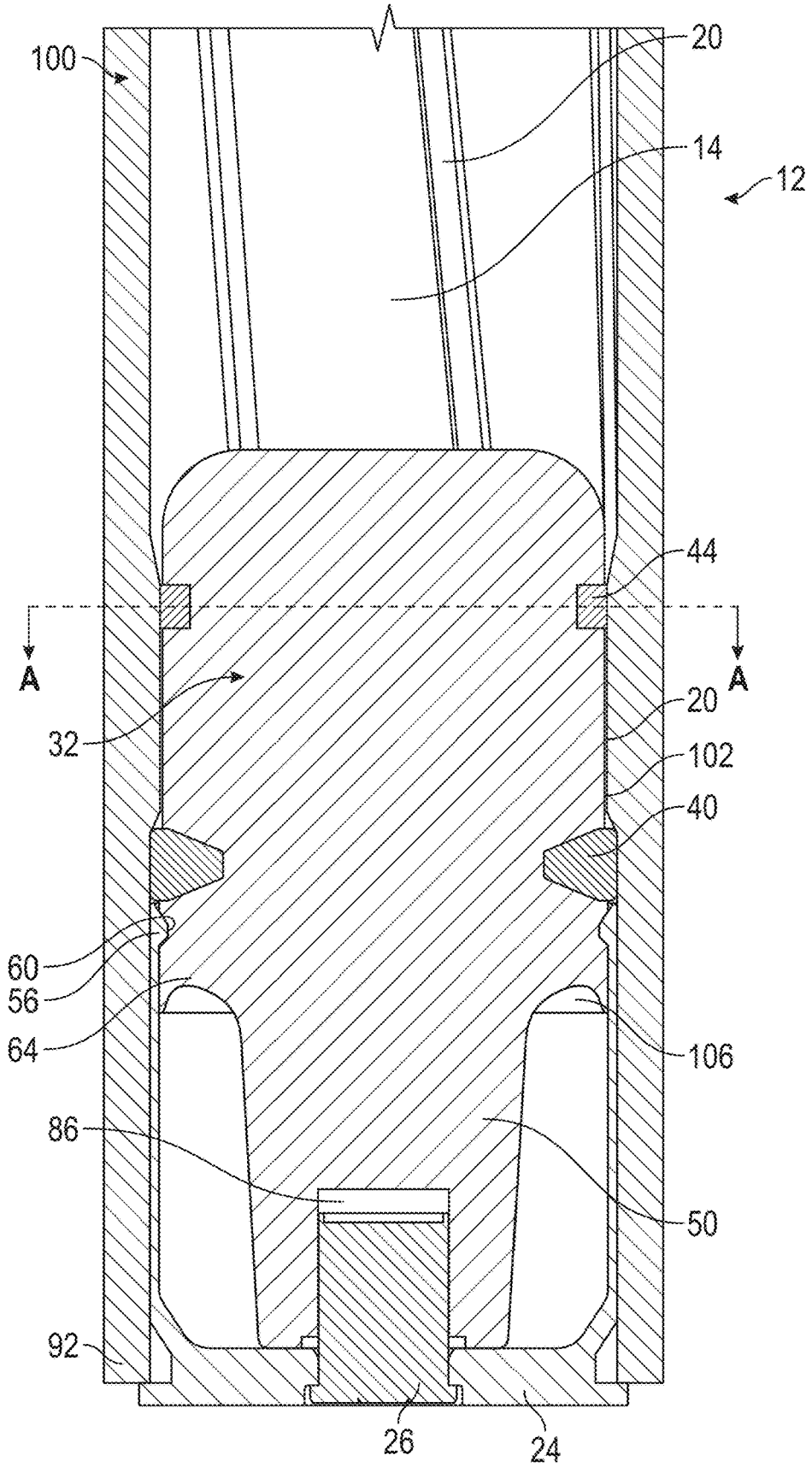
FIG. 5 shows a section view of the munition loaded into a barrel.

FIG. 5 shows a section view of a barrel 12 with the blunt impact munition cartridge 10 inserted. The barrel has a first end 92 defining a chamber 94 towards the breech face 96 of a firearm. There is an opposing second end 100 that goes to the muzzle of the barrel. The barrel is rifled beginning at the end of the chamber 102, having grooves 14 and lands 20. The length of a case 104 is inserted into the chamber. The commencement of rifling 102 is just in front of the polymeric driving band 40, shown here as a land 20. Beyond the projectile more rifling is visible, with grooves 14. As the projectile 32 moves forward, the polymeric driving band will contact via interference fit with the rifling and be engraved by it. The polymeric guide ring 44 is slip fit with the rifling lands. Prior to discharge, the projectile is retained within the case 24 by the frictional forces between the internal rib 56 being within the groove 60. The discharge of the propellant 24 causes the projectile to move forward. The movement has enough force to overcome the restriction on the projectile caused by the case rim within the groove. As the the flared portion 64 clears the case mouth 30 (not visible here) it expands outward, resulting in an interference fit between it and the rifling. This causes a seal for the pressure to increase behind the projectile. The space 106 creates an increased surface area for the pressure generated by the propellant to further push the projectile forward through the barrel.

Figure 6:
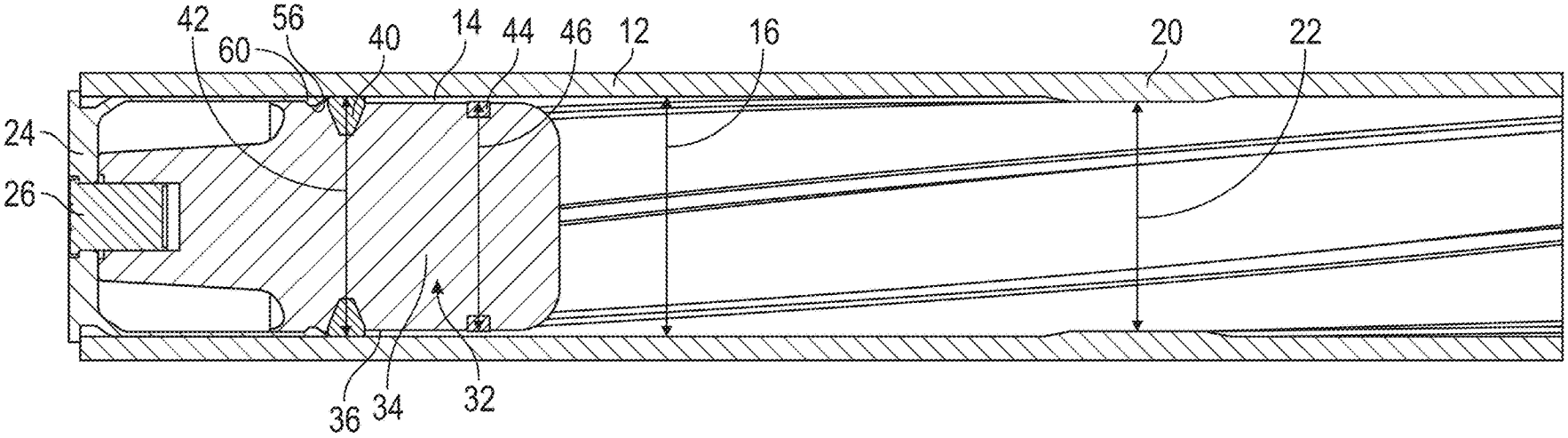
FIG. 6 shows another section view of the munition loaded into a barrel where the lands of the barrel are not visible, and the front guide band is not contacting the lands.

FIG. 6 shows show section view of a blunt impact munition cartridge 10 inserted into a barrel 12 having grooves 14 defining a first bore diameter 16 and lands 20 defining a lesser second bore diameter 22. The view shows the lands not in the plane of the section so that the polymeric guide ring 44 does not contact the lands. The cartridge comprising of a case 24 having a propellant 26 and defining a forward case mouth 30 (not visible here but shown in previous figures) and an elastomeric projectile 32. The projectile has a body portion 34 having a cylindrical sidewall 36 configured to be closely received in the barrel. The projectile includes a polymeric driving band 40 encircling the body portion and having a first ring diameter 42, and the projectile includes a second polymeric ring 44 encircling the body portion and having a second ring diameter 46 different from the first diameter. The first ring diameter is sized to be closer to the first bore diameter than the second bore diameter, being sized to have an interference fit with the lands. The second ring diameter is sized to be closer to the second bore diameter than the first bore diameter, being sized to have a slip fit with the lands. The polymeric guide ring is forward of the polymeric driving band. The polymeric driving band and polymeric guide ring are spaced apart, with the polymeric driving band proximate a rear end portion 50 of the body portion and the polymeric guide ring is proximate a forward end portion 52 of the body portion. The polymeric driving band and polymeric guide ring may be spaced apart by at least half the length of the cylindrical sidewall. The body portion has a body diameter 54, the first ring diameter is greater than the body diameter, and the second ring diameter is approximately equal to the body diameter such that the polymeric guide ring has an external surface approximately flush with the body portion cylindrical sidewall. The case has an internal rib 56 encircling the case mouth. The projectile defines a circumferential groove 60 receiving the case rib.

Figure 7:
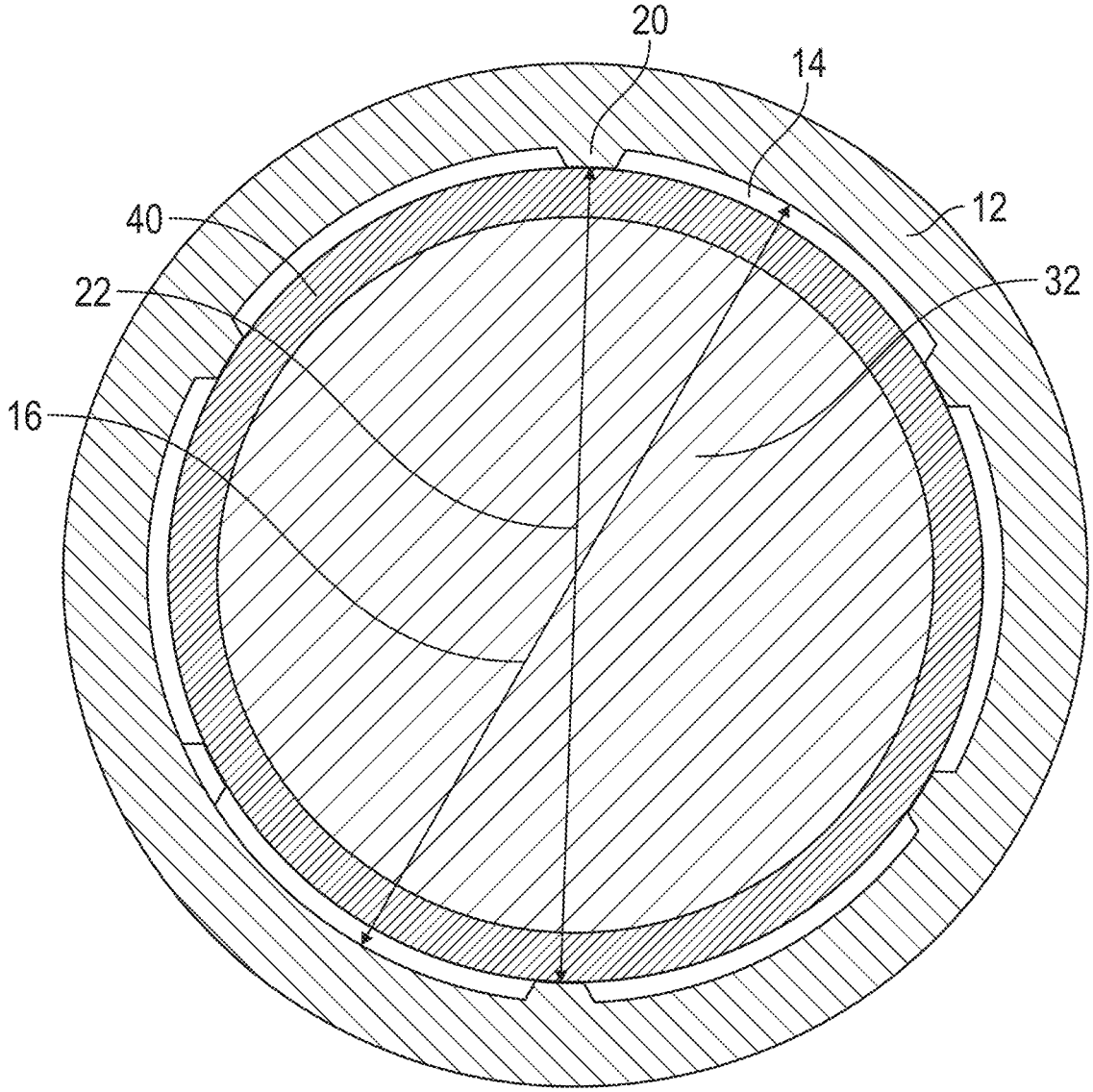
FIG. 7 shows a section view of the munition loaded into the barrel.

FIG. 7 shows a cross-section view of section line A-A of FIG. 6. The figure shows the body 34 of the projectile 32 of a blunt impact munition cartridge 10 inserted into a barrel 12 having grooves 14 defining a first bore diameter 16 and lands 20 defining a lesser second bore diameter 22. The projectile includes a polymeric driving band 40 encircling the body portion and having a first ring diameter 42. The first ring diameter is sized to be closer to the first bore diameter than the second bore diameter, being sized to have an interference fit with the lands.

Figures 8A, 8B:
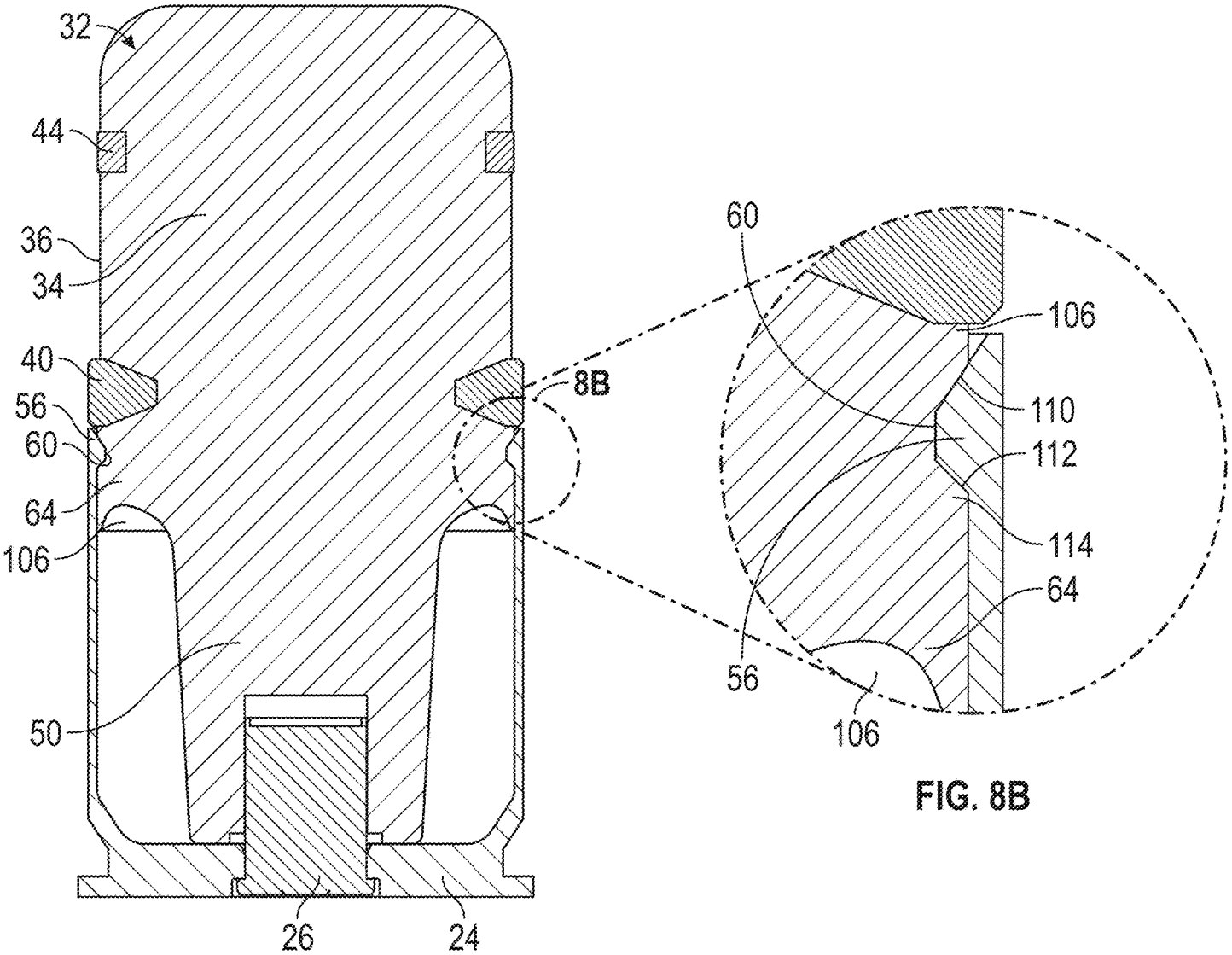
FIG. 8A shows a section view of the munition.
FIG. 8B shows an enhanced view of a portion of the munition in FIG. 8A.

FIG. 8A shows the section views of the blunt impact munition cartridge 10 of FIG. 3A. FIG. 8B shows an enhanced view of portion B of FIG. 8A, focusing on the circumferential groove 60 and internal rib 56 of the case 24. Specifically, the groove has an upper portion 106 that mates against the upper portion 110 of the rib, and a lower portion 114 of the groove fits against the lower portion 112 of the rib. This results in the projectile not being readily displaced by either a forward or backward movement and prevents the projectile 32 from detaching from the casing 24.

While current embodiments of a low energy cartridge have been described in detail, it should be apparent that modifications and variations thereto are possible, all of which fall within the true spirit and scope of the invention. Although pump-action shotguns and pistols have been disclosed, the low energy cartridge is also suitable for use with revolvers, semi-automatic and automatic assault rifles, carbines, machine pistols, and other firing devices designed to not resemble a conventional firearm. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A blunt impact munition cartridge for firing from a barrel having grooves defining a first bore diameter and lands defining a lesser second bore diameter, the cartridge comprising:

a case having a propellant and defining a forward case mouth;

an elastomeric projectile;

the projectile having a body portion having a cylindrical sidewall configured to be closely received in the barrel;

the projectile including a first polymeric ring encircling the body portion and having a first ring diameter; and the projectile including a second polymeric ring encircling the body portion and having a second ring diameter different from the first diameter.

2. The blunt impact munition cartridge of claim 1 wherein the first ring diameter is sized be closer to the first bore diameter than the second bore diameter.

3. The blunt impact munition cartridge of claim 1 wherein the second ring diameter is sized be closer to the second bore diameter than the first bore diameter.

4. The blunt impact munition cartridge of claim 1 wherein the first ring diameter is sized to have an interference fit with the lands.

5. The blunt impact munition cartridge of claim 1 wherein the second ring diameter is sized to have a slip fit with the lands.

6. The blunt impact munition cartridge of claim 1 wherein second ring is forward of the first ring.

7. The blunt impact munition cartridge of claim 1 wherein the first ring is proximate a rear end portion of the body portion and the second ring is proximate a forward end portion of the body portion.

8. The blunt impact munition cartridge of claim 1 wherein the body portion has a body diameter, and the first ring diameter is greater than the body diameter.

9. The blunt impact munition cartridge of claim 1 wherein the body portion has a body diameter, and the second ring diameter is equal to the body diameter.

10. The blunt impact munition cartridge of claim 1 wherein the second ring has an external surface flush with the body portion cylindrical sidewall.

11. The blunt impact munition cartridge of claim 1 wherein the first and second rings are spaced apart.

12. The blunt impact munition cartridge of claim 11 wherein the first and second rings are spaced apart by at least half the length of the cylindrical sidewall.

13. The blunt impact munition cartridge of claim 1 wherein the case has an internal rib encircling the case mouth.

14. The blunt impact munition cartridge of claim 13 wherein the projectile defines a circumferential groove receiving the case rib.

15. The blunt impact munition cartridge of claim 1 wherein the first and second rings are different material from the body portion.

16. The blunt impact munition cartridge of claim 1 wherein the body portion is elastomeric.

17. The blunt impact munition cartridge of claim 16 wherein the first and second rings are polymeric.

* * * * *